US005836622A

United States Patent [19]

Fabel

[11] Patent Number: 5,836,622

[45] **Date of Patent: *Nov. 17, 1998**

[54] SINGLE SIDE IMAGED POST CARD ASSEMBLY

[75] Inventor: Warren M. Fabel, Delray Beach, Fla.

[73] Assignee: Laser Substrates, Inc., Boca Raton, Fla.

[ * ] Notice: The terminal 25 months of this patent has been disclaimed.

[21] Appl. No.: 49,946

[22] Filed: Apr. 20, 1993

[51] Int. Cl.[6] ..... B42D 15/02

[52] U.S. Cl. ..... 283/62; 462/6; 283/116; 229/92.8

[58] Field of Search ..... 283/62, 100, 116, 283/117; 462/2, 901, 6, 64; 229/92.1, 92.8

[56] References Cited

U.S. PATENT DOCUMENTS

| | | | |
|---|---|---|---|
| 4,070,778 | 1/1978 | Mahler et al. | 229/92.8 X |
| 4,418,865 | 12/1983 | Bowen | 462/64 X |
| 4,682,793 | 7/1987 | Walz | 462/219.01 |
| 4,825,574 | 5/1989 | George | 229/92.8 X |
| 4,865,669 | 9/1989 | Schmidt | 462/901 X |
| 4,885,198 | 12/1989 | Kimura | 283/62 X |
| 5,173,081 | 12/1992 | Greig | 462/6 |
| 5,183,203 | 2/1993 | Sanders | 462/6 X |

FOREIGN PATENT DOCUMENTS

| | | | |
|---|---|---|---|
| 0007398 | 1/1991 | Japan | 283/100 |

*Primary Examiner*—Timothy V. Eley
*Assistant Examiner*—Khan V. Nguyen
*Attorney, Agent, or Firm*—Quarles & Brady

[57] ABSTRACT

A form for creating a postcard having printing on both sides includes a front sheet and a back sheet, which are laminated using a pressure sensitive adhesive on a back surface of the front sheet. A fold line extends across the front sheet, while a tear line underlying the fold line extends across the back sheet. A gap in the adhesive preferably extends along the fold line. On one side of the fold line opposite to the direction of the gap, the inner surface of the back sheet has a release coating restricting the adhesion of the adhesive layer. After printing on the front surface of the front sheet, the section of the back sheet having this release coating is removed and discarded, and the front sheet is folded along the fold line, thereby providing a document having printing on both sides and a thickness sufficient for a postcard.

19 Claims, 6 Drawing Sheets

SINGLE SIDE IMAGED POST CARD ASSEMBLY

BACKGROUND OF THE INVENTION

1. Field of the Invention

This invention relates to a form which, having an image placed on a single side thereof, can be folded in a particular way to provide a double sided image, and more particularly, to means for generating, from a single form printed on a single side, various documents needed for sending certified mail.

2. Background Information

Many types of specialized business forms are made for use with the impact printing process, which is available using a typewriter or any of a number of printers using raised type or wire matrices. These printing processes are characterized by an ability to generate multiple copies through the use of carbon paper between copies, or through the alternative use of other micro-encapsulated materials sensitive to pressure and impact. Many of the impact printers are configured to accept continuous forms with holes along the edges for feeding by means of a pin feed mechanism. Typewriters accept individual sheets of paper, while a number of modern low to medium speed printers accept both continuous forms with edge holes and individual sheets.

A number of forms include multiple sheets, or plies, affixed together to take advantage of the ability of the impact printing process to make multiple copies with a single pass through the printer. An example of this type of form is described in U.S. Pat. No. 4,682,793, issued to Gerard F. Walz on Jul. 28, 1987 and entitled "Multi-Part Mailer Form Assembly". As described in the Walz patent, a multi-part mailer form assembly includes a series of superimposed continuous sheets, each having spaced transverse tear lines for separating the sheets into individual multi-part forms. Opposite marginal edges of the assembly have superimposed pin feed perforations, and the sheets are adhesively secured together along one marginal side edge and are separable from each other by means of tear lines. The front sheet is of paper, the rear sheet is of card, and the intermediate sheets include at least one paper sheet with copy producing layers or means provided for reproducing information imprinted on the front sheet, on the paper and card sheets. The sheets each have a designated address area in registry with corresponding designated address areas on all the other sheets. The rear sheet has tear lines for separating a predetermined sized area of the rear sheet, carrying an address area on both faces from the rest of the sheet, and has adhesive strips on its outer face adjacent and outside the predetermined detachable area for securing it to an envelope or package. The multi-part form is described particularly as a means of providing the various forms required by the U.S. Post Office for mailing a certified letter.

The increased use of nonimpact printing devices in most offices, such as laser or ink jet printers, has led to a need to provide the capabilities commonly associated with impact printer forms, that is the ability to use specialized multi-part forms. This need is particularly important, since nonimpact printers, with their greater flexibility in providing different type fonts and graphics capabilities, higher throughput, lower operating costs, and much better print quality, as well as the reduced noise, are replacing impact printer in most offices. Thus, people needing the advantages provided by impact printers for specialized forms are not able to fulfill their needs because of the lack of an impact printer.

Nonimpact printers are limited by an ability to print only on a single side of one sheet of paper at a given time. While it is possible to turn the paper over to be run through the printer again, to thereby print on both sides, automated devices which accomplish this function are not commonly available with conventional office nonimpact printers found in most offices. Even if one could print on both sides of the form by manually feeding the same form again, this practice eliminates batching, whereby a large number of blank forms are placed in a paper feeding tray and all forms are produced at one time.

One of the other advantages of impact printing, particularly those impact printers using pin feed paper handling mechanisms, is the ability to print on paper stocks of significantly different thicknesses. For example, conventional paper stock has thicknesses of about 0.003 to 0.0035 inch and post cards required by the U.S. Postal Service have a thickness of between 0.007 inch and 0.0095 inches. However, feeding a relatively thick card stock through a conventional office nonimpact printer may cause problems with the paper handling mechanisms and as well as with the copy quality. Thus, many existing forms, such as the postcard thickness last sheet described in U.S. Pat. No. 4,682,793 to Walz, cannot be used with nonimpact printers. Thus, many documents designed to be sent through the mail as postcards, such as is needed for certified or registered mail, cannot be automatically generated with modern office nonimpact printers.

SUMMARY OF THE INVENTION

In accordance with one aspect of the invention, there is provided an assembly for providing a folded document with images formed on both sides thereof, following a single pass through an image forming device which places an image on one side of the assembly. The assembly has a front sheet with an image receiving surface and an adhesive coated surface. In addition, the assembly has a back sheet having a first tear line between interior and facing surfaces. The interior surface is affixed to the adhesive coated surface of the front sheet such that a permanent bond is formed on one side of the tear line and a releasable bond is formed on the other side of the tear line. In addition, the assembly has a fold line on the front sheet aligned with the tear line when the front sheet and back sheet are affixed.

BRIEF DESCRIPTION OF THE DRAWINGS

Preferred embodiments of the subject invention are hereafter described with specific reference being made to the following Figures, in which.

DETAILED DESCRIPTION

Figure 1:
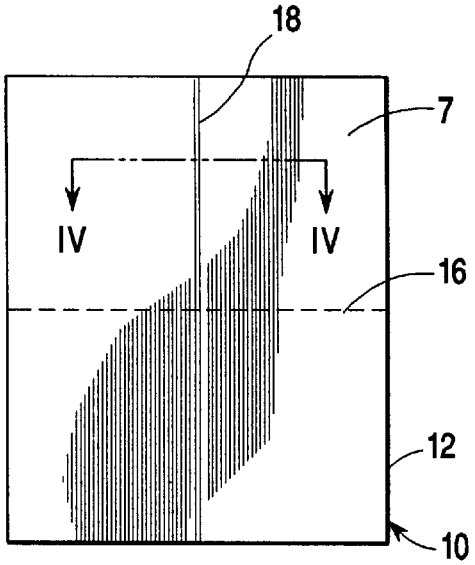
FIG. 1 is a front elevational view of a first embodiment of this invention.

FIGS. 1 through 4 show the details of construction of a first embodiment of this invention, which provides a means for generating two postcards from a single form 10. Form 10 is preferably of a size which can be conveniently fed through a standard image forming device, such as a standard impact or nonimpact printer commonly found in many offices, either as a single document, or as a stack of documents from which a number of postcards will be made. Form 10 is constructed by laminating a the interior facing side 8 of a front sheet 12 to the interior facing side 9 of a back sheet 14. Sheets 12 and 14 may be made by applying adhesive and release material coatings to various types of paper stocks, which are preferably of ordinary thickness, about 0.003 inch. While paper is preferably used for sheets 12 and 14, other materials capable of receiving printed images and capable of adhesive attachment can be used as well.

Figure 2:
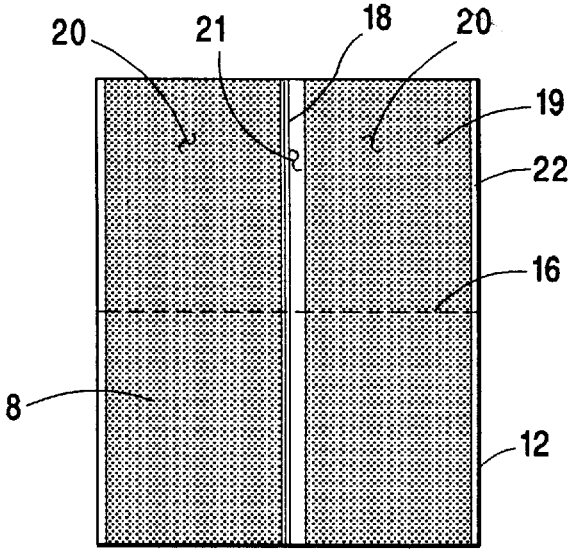
FIG. 2 is a rear elevational view of a front sheet in the embodiment of FIG. 1.

FIG. 1 shows a front view of form 10 and of the image receiving surface 7 of front sheet 12, which is divided into two sections by a tear line 16. A central fold line 18 is also applied to facilitate the proper folding of the form into two postcards. FIG. 2 shows a view of the interior facing side of front sheet 12, indicating two adhesive panels 20, preferably composed of a pressure sensitive adhesive material 19, which may be applied by coating during the process of manufacturing sheet 12. A central gap 21 in the coating, having a width of about a half inch, preferably extends along one side of fold line 18 to further facilitate the subsequent proper folding of form 10 into postcards. A peripheral gap 22 in the coating preferably extends along two or more edges of sheet 12 to minimize a potential problem of adhesive 19 being squeezed outward from between front sheet 12 and rear sheet 14 during the application of pressure to fuse toner in a laser printer.

Figure 3:
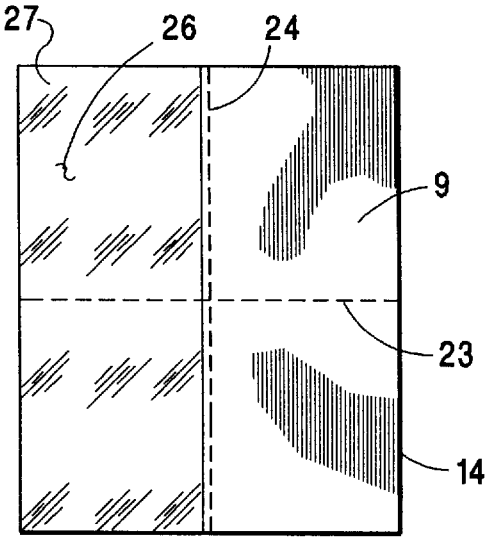
FIG. 3 is a front elevational view of a back sheet in the embodiment of FIG. 1.

FIG. 3 shows a view of the interior side 9 of back sheet 14, which is divided into four sections by centered and perpendicular tear lines 23 and 24. A release panel 26 is formed by coating one surface of back sheet 14 with a release material 27, such as a silicone release material. Release panel 26 is a type which can be easily pulled away from the pressure sensitive adhesive 19 used to form adhesive panels 20 (shown in FIG. 2).

Figure 4:
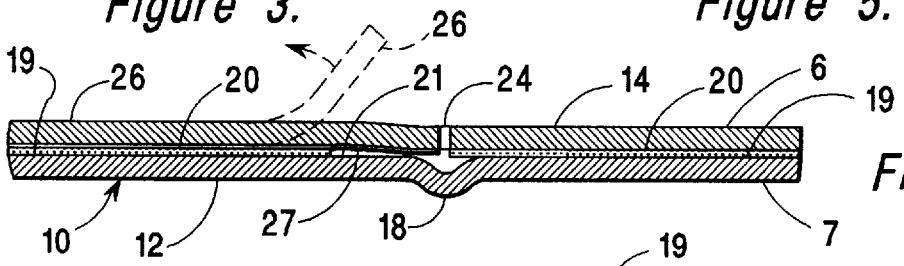
FIG. 4 is a partial transverse cross-sectional view of the embodiment of FIG. 1, taken as indicated by section lines IV—IV in FIG. 1.

FIG. 4 is a transverse cross-sectional view of form 10, taken across lines IV—IV of FIG. 1, after assembly of form 10 by pressing the interior side 8 of front sheet 12 (shown in FIG. 2) against the interior side 9 of back sheet 14 (shown in FIG. 3), leaving the outward facing side 6 of back sheet 14 and image receiving side 7 of front sheet 12 exposed. While back sheet 14 adheres to both adhesive panels 20 of front sheet 12, the portion of back sheet 14 having release panel 26 is releasably adhered, so that it can be subsequently peeled off and torn away, as seem by the dashed lines. Gap 21 in the adhesive coating 19 overlies a central edge portion of release panel 26. It should be noted that when sheets 10 and 12 are assembled as described in FIGS. 1–4, transverse tear line 23 underlies transverse tear line 16 to allow the subsequent separation of form 10 into two halves.

Figure 5:
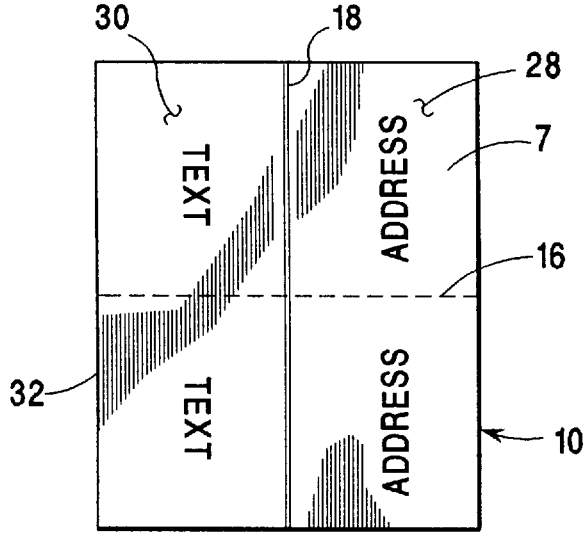
FIG. 5 is a front elevational view of an application of the embodiment of FIG. 1, showing the relative placement of information thereon during a printing step.
Figure 6:
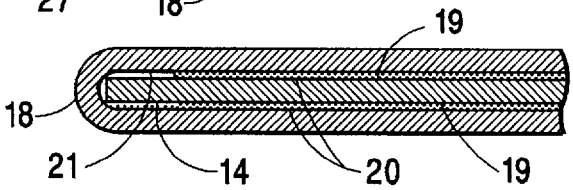
FIG. 6 is a partial transverse cross-sectional view of an application of the embodiment of FIG. 1, following a folding step.

One use of form 10 is shown in FIGS. 5 and 6, in which two postcards are formed by first printing address and text information on form 10 and thereafter, by dividing form 10 into two postcards by separating it along aligned tear lines 16 and 23, by peeling away release panel 26 and by folding the exposed adhesive 19 covered portion of front sheet 12 over the remaining portion of back sheet 14. FIG. 5 schematically illustrates the appearance of form 10 after the printing step. Each postcard has an address side 28 and a text side 30, with the printed material on each side being preferably oriented, as shown, to be read away from fold line 18.

A printer, controlled by a conventional computer system, is preferably used to print information as shown in FIG. 5, with the computer system under the control of a program designed or modified specifically for this type of application.

While many word processing programs and printers can print sideways, or in the "landscape mode", all letters still face the same direction. However, most word processing programs in common use today, do not include the capability of printing letters with different orientations, such that some of the printed material is orientated relative to one side and the remaining printed material is orientated from the other side, as shown in FIG. 5. However many other commercially available programs, such as CAD/CAM programs do have this capability and it is a relatively straightforward matter to design a computer program with typefaces having this capability. Such a program could also have the ability to generate other markings required or desired by the U.S. Postal Service, such as the Facing Identification Mark (FIM) patterns, placed to the left of the area to which a stamp may be affixed, for identifying identify certain types of mail, and the POSTNET bar code, placed along the lower edge of the card, which represents the ZIP code of the address.

FIG. 6 shows the configuration into which each postcard is folded after the address information 28 and text information 30 is printed, panel 26 is removed and the adhesive 19 exposed portion of front sheet 12 is folded over and attached to the remaining portion of back sheet 14. More specifically, the two postcards shown in FIG. 5 may be separated by separation along tear lines 16 and 23, either before of after folding. Before folding, the side of back sheet 14 upon which release panel 26 is coated is peeled back from front sheet 10 and discarded. The post card being formed is then folded along central fold line 18, with the adhesive panel 20 exposed by the removal of release panel 26 being brought into contact with the rear surface of the remaining side of back sheet 14. The post card thus formed is pressed together to form a permanent assembly on both sides of the pressure sensitive adhesive 19 in panel 20.

In this way, a postcard is formed, having a thickness of three sheets of paper, that is twice the thickness of front sheet 12, together with the thickness of back sheet 14, and the relatively negligible thickness of two layers of adhesive 19. Before the separation and folding processes, the back sheet 14 acts to protect the entire adhesive 19 coated surfaces from contact with other objects. After the folding process, half of the back sheet 14 acts to increase the thickness and stiffness of the postcard.

Figure 7:
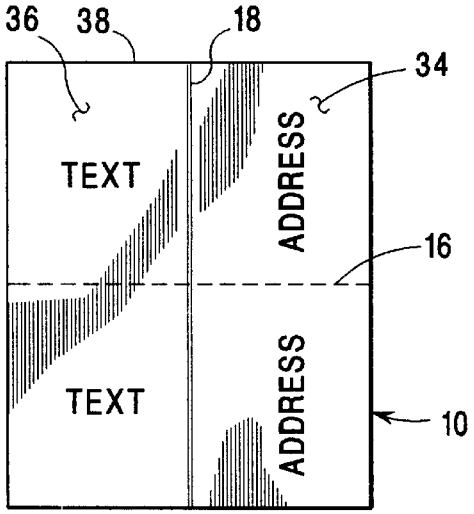
FIG. 7 is a front elevational view of an alternative application of the embodiment of FIG. 1, showing the relative placement of information thereon during a printing step.

FIG. 7 illustrates an alternative technique to print information on a form 10 using commercially available software. In FIG. 7, each postcard has an address side 34 and a text side 36, with the printed material on address side 34 being oriented to be read downward from the adjacent fold line 18, and with the material on text side 36 being oriented to read downward from a short side 38 of form 10. The primary advantage of the printing format shown in FIG. 7 is that it can be produced using a standard word processing program, such as Word Perfect 5.1, with a system having "landscape" printing mode capabilities. A method for obtaining a format with type running in two directions in this way is described, for example, in *Using Word Perfect* 5.1, *Special Edition*, Que Corporation, Carmel, Ind., 1989, pp. 1134–1138.

One problem typically associated with the use of a pressure sensitive adhesive is caused by the instantaneous nature of the bonding process with such an adhesive. After two objects are brought together, it is difficult or impossible to move them for improving their alignment. This problem is alleviated by forming fold line 18, extending along the line where the fold is to occur, during the process of manufacturing form 10. This problem is further alleviated by providing central gap 21 between adhesive panels 20, so that the folding process can include the alignment of the two sides of front sheet 12 before contact is made between the exposed adhesive panel 20 and the rear surface of back sheet 14.

While the adhesive used in the various embodiments described herein are typically described as being pressure sensitive, or contact, adhesives, it is understood that other adhesives, such as moisture activated adhesives, could be used instead.

The various embodiments described herein also include a number of tear lines. This term is meant to describe a line along which the material of a sheet is weakened so that it can be easily separated. Tear lines may be formed, for example, by perforating the sheet, so that a line is formed among a plurality of holes, or by die cutting a series of slots in alignment, so that the sheet material between the slots can be easily broken. When tear lines are superimposed on the front and back sheets, they may be produced after the sheets are assembled. It is also possible to limit the penetration of a die, so that die cut lines can be cut through only one sheet after assembly.

These embodiments also include a number of fold lines, which provide lines along which folding preferably occurs. Such lines may be produced, for example, by embossing, by creasing the sheet, or by simply printing a line indicating where a manual fold should be made.

U.S. Postal regulations require a minimum thickness of 0.007 inch, with an indication that card stock should not exceed 0.0095 inch when firmly compressed. It is expected that these limits may be increased somewhat as automated mail handling equipment comes into wider use, requiring greater strength and stiffness in individual pieces of mail to prevent double feeds on automatic sorting equipment. In any case, a suitable overall card thickness can be easily achieved by using a typical paper thickness of about 0.003 inch for front sheet 12 and back sheet 14.

The size of form 10, before folding, is preferably a size which may be conveniently run through a standard printer, and the size of the postcards formed by this process is preferably one which is acceptable to postal authorities for mailing at the reduced postal rates available for postcards. For example, form 10 may be 8.4 by 11 inches, thereby forming two 4.2 by 5.5 inch postcards. Alternatively, a conventional 8.5 by 11 inch sheet of paper with a discardable edge portion may be used to bring the size of the resulting postcards within Postal Service regulations. By using forms 10 having a size as noted above permits a large number of forms 10 to be stacked in a printer feeding tray for sequential feeding through the standard paper feed mechanism of a printer. Thus, the present invention provides the advantage of using special forms with a standard office printer under the control of a computer system, whereby a large number of documents of similar types, having variations in printed text, can be generated in a more or less continuous process, without a necessity for loading individual forms into the printer.

Figure 8:
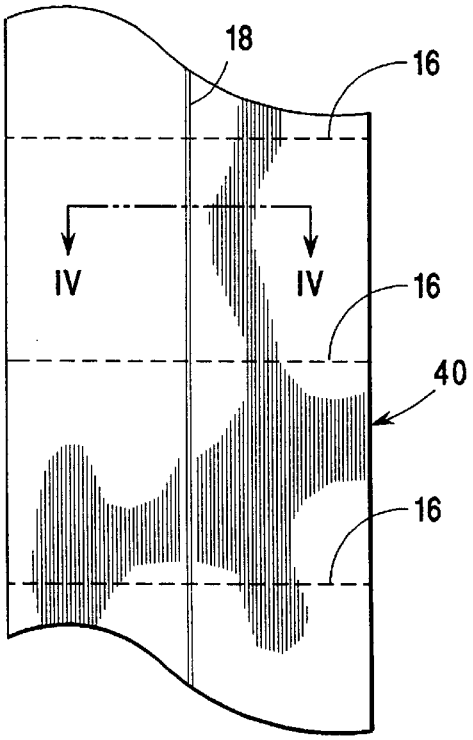
FIG. 8 is a partial front elevational view of a second embodiment of this invention, being configured as a continuous form.

Referring now to FIG. 8, a front elevational view of a second embodiment of the present invention is shown, in which a continuous form 40 is provided for use in a printer having a capability of printing continuous documents. In FIG. 8, features similar to those discussed above with respect to form 10 are referenced with like numerals. A central fold line 18 is provided for use as previously described, with a number of transverse tear lines 16 being included to facilitate the separation of form 40 into many individual postcards after printing. Most other aspects of form 40 are as previously described with respect to form 10, with the transverse cross-section of form 40, taken as indicated by section lines IV—IV, being also shown in FIG. 4. Thus, form 40 includes front and back sheets, with a back sheet including transverse tear lines underlying tear lines 16 and central fold line 18. The rear surface of the front sheet of form 40 includes a pair of adhesive panels 20 extending the length of form 40, and the front surface of the back sheet of form 40 includes a release material 27 at one side of a central tear line 24.

Figure 9:
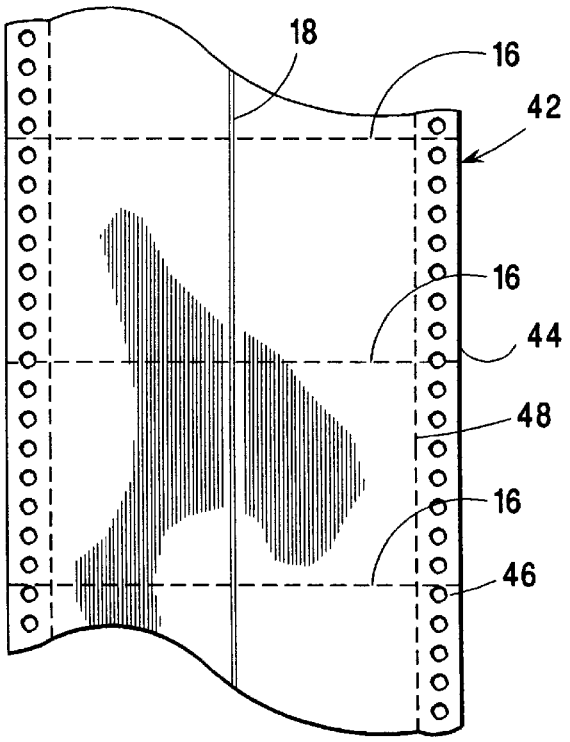
FIG. 9 is a partial front elevational view of an alternative variation of the embodiment of FIG. 8, being configured for use with a pin feed mechanism.

FIG. 9 is a front elevational view of a form 42, which is a variation of form 40 shown in FIG. 8. Form 42 has one or both of the front and back sheets extended to include lateral strips 44 with holes 46 for use by a standard pin feed paper handling mechanism. Tearlines 48 extend between the lateral strips 44 and the adjacent portions of form 42, so that strips 44 can be easily torn away and discarded after the printing process.

Figure 10:
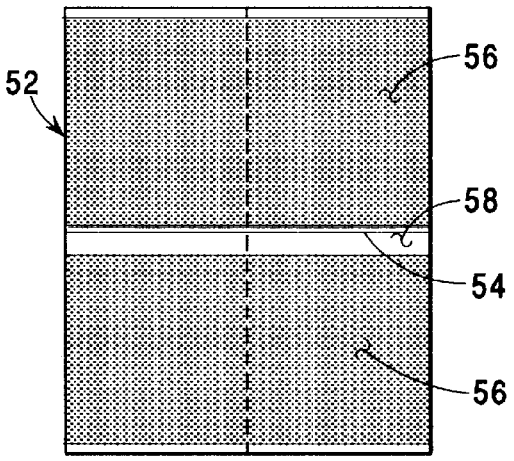
FIG. 10 is a rear elevational view of a front sheet used in a third embodiment of this invention.
Figure 11:
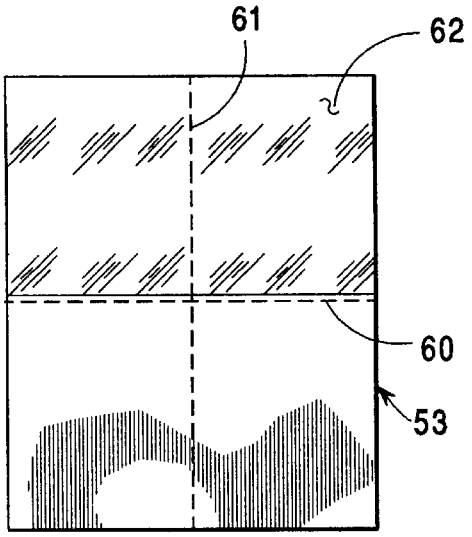
FIG. 11 is a front elevational view of a back sheet used with the front sheet of FIG. 10.
Figure 12:
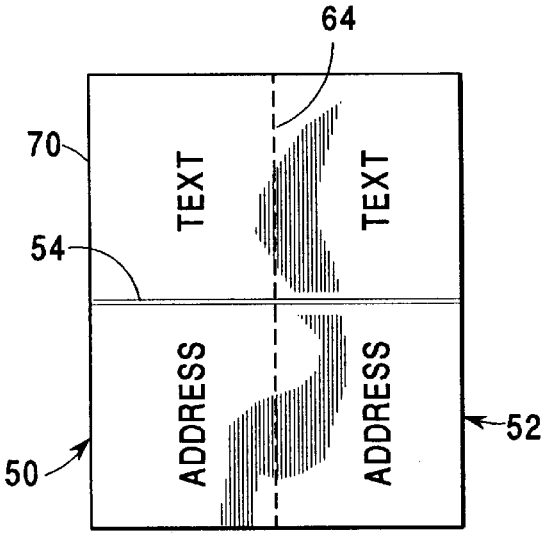
FIG. 12 is a front elevational view of an application of the embodiment of FIG. 10, showing the relative placement of information thereon during a printing step.

FIGS. 10 through 12 show a form 50, which is a third embodiment of the invention. FIG. 10 is a rear elevational view of a front sheet 52 used in the construction of form 50, while FIG. 11 is a front elevational view of a back sheet 53 used therein. FIG. 12 is a front elevational view showing the use of form 50.

Referring first to FIG. 10, the details of construction of form 50 are similar to those of form 10, except that form 50 is configured for folding along a fold line 54 extending transversely across front sheet 52, while form 10 is configured for folding along a fold line 18 extending longitudinally along front sheet 12 (shown in FIG. 1). Thus, the rear surface of front sheet 52 includes a pair of adhesive panels 56 on opposite sides of fold line 54, with a central gap 58, about a half inch in width, extending in one direction from fold line 54 to separate the panels 56.

Referring to FIG. 11, back sheet 53 includes a transverse tear line 60, which underlies fold line 54 of front sheet 52 (shown in FIG. 10) when sheets 52 and 53 are assembled together, and a longitudinal tear line 61. A release coating layer 62 is applied to the front surface of back sheet 53 on one side of transverse tear line 60. The side of back sheet 53 having release coating layer 62 is laminated to the side of front sheet along which coating gap 58 extends.

FIG. 12 shows a postcard application of form 50. Two postcards are printed with address data 64 and text data 66, to be separated along a longitudinal tear line 68 and folded along fold line 54. Text and data information is preferably all oriented to read downward from one of the longer edges 70 of the form. Tear line 61 underlies tear line 64 when sheets 52 and 53 are assembled together to make form 50. One advantage of this configuration arises from the fact that a conventional relationship between the orientation of text and address information occurs when all text and address information is oriented in the same direction during the printing process. This orientation can be easily attained using the standard "landscape" mode of a printer.

FIGS. 13 through 18 show various aspects of a fourth embodiment of the invention, in which a single form 72 provides various elements required for sending certified mail. Form 72 is preferably 8" by 14 inches, a size which can be easily handled by standard printers. Certain information, generally required by the Postal Service may be pre-printed on form 72, while other information, which may be customized for each mailing, is printed on form 72 by a printer. Form 72 is preferably passed through a printer controlled by a computer system operating under control of a software program developed to place specific information in certain places on the form.

Generally, form 72 includes a front sheet 74 and a back sheet 75, each of which preferably has a thickness of a standard sheet of paper, about 0.003 inch. Sheets 74 and 75 are held together with an adhesive material 76 layer coated on the rear surface of front sheet 74. In certain locations, described in detail hereafter, a release material 77, such as a silicone compound, is coated on the front surface of back sheet 75, so that certain parts of back sheet 75 can be readily detached from the assembled form 72.

Figure 14:
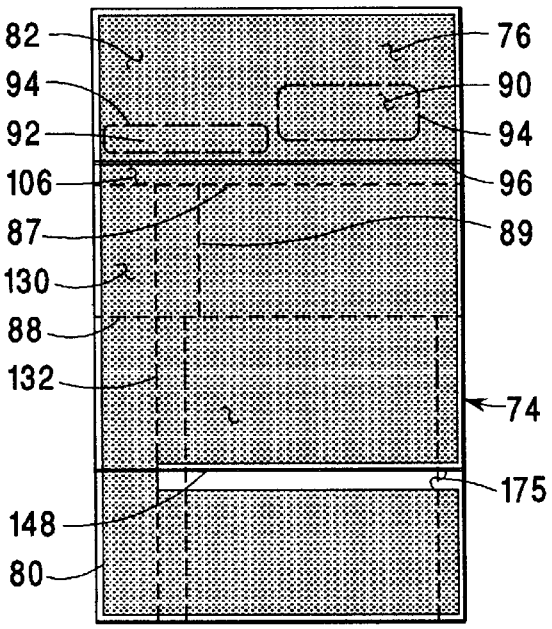
FIG. 14 is a rear elevational view of a front sheet used in the embodiment of FIG. 13.
Figure 15:
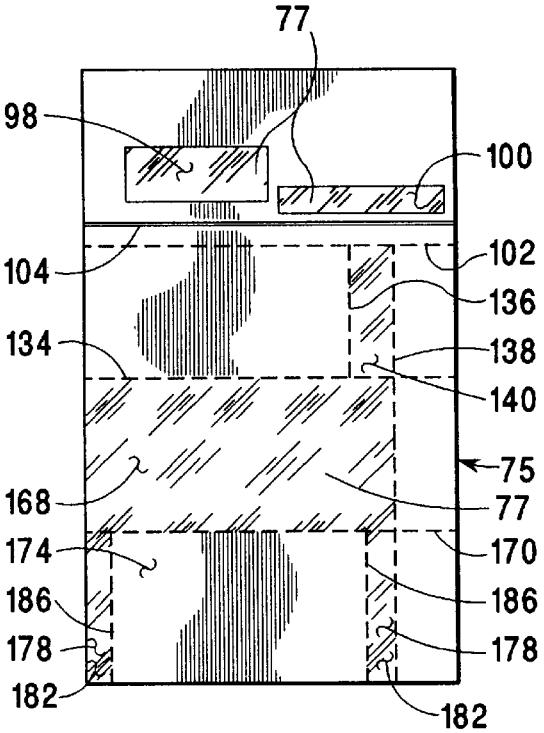
FIG. 15 is a front elevational view of a back sheet used in the embodiment of FIG. 13.
Figure 13:
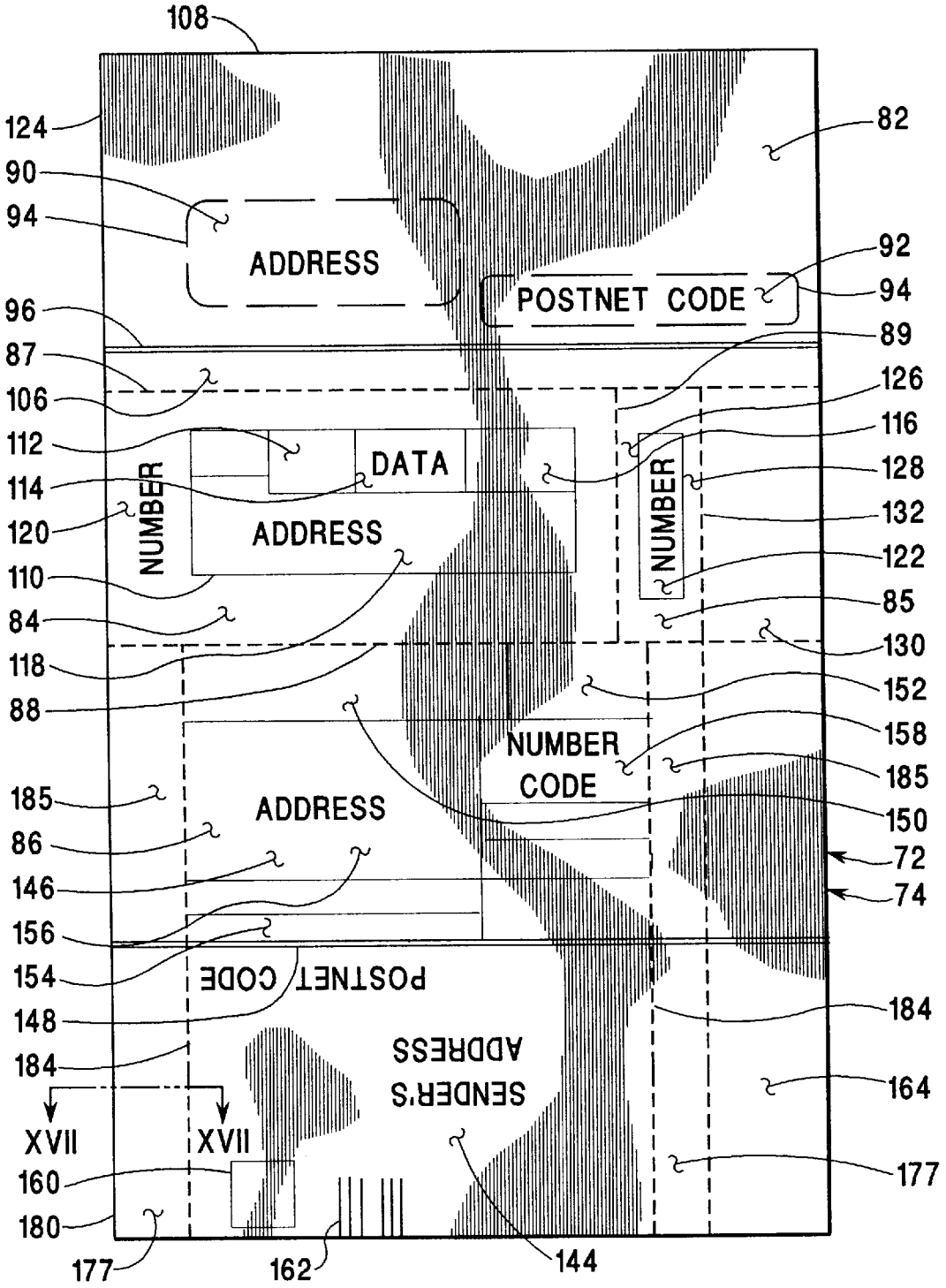
FIG. 13 is a front elevational view of a fourth embodiment of the invention, showing the relative placement of information thereon during a pre-printing step and during a printing step within a non impact printer.

With respect to form 72, FIG. 13 shows the front of form 72, and specifically the front, of facing, side of front sheet 74 and the location of various tear lines and fold lines. FIG. 13 also indicates, in a general manner, both the type of general information which may be pre-printed on form 72, and the type of selective information printed during a pass through a printer. FIG. 14 shows the back of front sheet 74, and more particularly, the pattern of a pressure sensitive adhesive material 76 layer. A margin 80, about 1/16 inch wide, is provided around panel 76, so that adhesive 76 is not squeezed out of the form during passage through the fuser of a laser printer. FIG. 15 shows the front, or facing side back sheet 75, including the pattern of the coated release material, together with various tear lines and fold lines.

Referring specifically to FIG. 13, the front of form 72 includes an address section 82, a sender's receipt section 84, a certified mail label 85, and a return receipt 86. These sections are mutually separable by means of transverse tear lines 87 and 88, and by a tear line 89 extending between sender's receipt section 84 and certified mail label 85. While address section 82 is included to provide assistance in preparing an envelope for mailing, sender's receipt section 84, certified mail label 85, and return receipt 86 are included to replace specialized materials which are otherwise available from the U.S. Postal Service, in order that these materials can be readily filled out through the use of a printer. Address section 82 includes a pair of removable label areas 90 and 92, which are defined as separable from the remainder of section 82 by means of die cut tear lines 94. When form 72 is passed through a printer, the address to which the certified letter is to be sent is printed on label area 90, and the POSTNET code, which is a bar code representing the ZIP code of the address, is printed on label area 92. As seen in FIG. 14, an adhesive material 76 layer, coated on the rear surface of front sheet 74, holds the portion of address section 82 lying above a fold line 96 in place on the corresponding portion of back sheet 75, seen in FIG. 15.

Referring to FIG. 15, on the interior surface of back sheet 75, release materials 77, such as silicone release coatings, are placed over panels 98 and 100, which underlie label areas 90 and 92, respectively. Thus, the label areas 90 and 92 can be easily removed from form 72 by tearing along die cut tear lines 94 and by peeling label areas 90 and 92 away from the corresponding coated portions of back sheet 75. Back sheet 75 also includes a transverse tear line 102 underlying transverse tear line 87 of front sheet 74, and a fold line 104 underlying fold line 96 of front sheet 74.

After the printing has occurred, address section 82 is separated from sender's receipt section 84 by tearing along superimposed transverse tear lines 87 and 102. Address section 82 is designed to fit into a standard window envelope, that is, an envelope with a transparent window in a standard location, through which a printed address is visible through the window. To permit address section to fit into a standard window envelope, the lower tab 106 formed between aligned tear lines 87 and 102 and aligned fold lines 96 and 104 is folded upward behind the remaining portion of section 82, along superimposed fold lines 96 and 104. In a preferred version, the length of address section 82, is sufficient to provide a standard overall length of 14 inches for form 74, with lower tab 106 having a width sufficient that section 82, when folded as described, can fit into a standard number nine or number ten window envelope.

While standard window envelopes do not presently have provisions for viewing a POSTNET bar code through a window, it is felt that, as the preparation of this coded information by the originator of mail, instead of by the U.S. Postal Service, becomes more widespread, such window envelopes will become available. In any event, a standard spatial relationship is maintained between the address printed on label area 90 and the POSTNET code printed on label area 92.

Where window envelopes are not used, or window envelopes having only an address window are used, one or both of the label areas 90 and 92 may be easily detached for application to the outside of an envelope. Because of the presence of release materials 77 in panels 98 and 100, the adhesive material 76 coated on the rear surfaces of label areas 90 and 92 is not damaged when one of the labels is peeled away from back sheet 75; adhesive material 76 layer can then be reused to attach the label areas to another surface, such as an envelope or package to be sent by certified mail.

Sender's receipt section 84 is preferably designed to provide the functions of Postal Service Form 3800, being divided into a number of blocks by a pattern of pre-printed lines 110. Front sheet 74 is preferably white, with pre-printed information on sender's receipt section 84 being printed in a green color used by the U.S. Postal Service to signify such documents associated with certified mail. Block 112 has a pre-printed number of postal fees associated certified mail. These fees may be calculated and a total provided by the program controlling the operation of the printer, to be printed at adjacent locations in block 114. Block 116 provides a location where a postmark stamp can be placed by a postal official. The address to which the certified mail is sent is printed by the printer in block 118. Form 72 is also provided with a conventional certified mail identifying number, which is printed both at the left margin 120 of sender's receipt section 84 and at a central area 122 of certified mail label 85. In accordance with postal regulations, this number is a nine digit number preceded by the letter "P," with spaces between the letter and the number and between three groups of three digits each. The identifying number is printed in OCR-A font for optical character recognition read downward from left edge 124 of form 72.

Certified mail label 85 is preferably pre-printed with a green border around central area 122, using the same green ink used to pre-print information on sender's receipt section 84. While not shown, the words "CERTIFIED" and "MAIL" appear in reverse printing in locations 126 and 128 within the border, to be read downward from left edge 124 of form 72. Reverse printing may occur by not pre-printing the green ink so as to form the words "CERTIFIED" and "MAIL". Thus, the words "CERTIFIED" and "MAIL" appear white, as front sheet 74, within the solid green border around area 122.

A discardable section 130, adjacent to certified mail label 85, and separable therefrom by means of a tear line 132, is discarded during the use of form 72. The additional material 130, as well as the additional material in discardable section 164 (discussed hereafter), is included within form 72, so that the overall dimensions of form 72 conform to the standard paper size eight and one half by fourteen inches, while maintaining the various sections within form 72 to the standard dimensions required therefore.

Referring to FIG. 15, back sheet 125 includes tear lines 134, 136, and 138 underlying tear lines 88, 89, and 132 of front sheet 74, so that sender's receipt section 84, certified mail label 85, and discardable sections 130 and 164 can be easily separated. A release panel 140, coated with release material 77, is provided in on the interior surface of the portion of back sheet 125 underlying certified mail label 85, so that the portion of front sheet 74 forming label 85 can be easily removed from back sheet 75, exposing an intact adhesive 76 covered surface for attaching label 85 to the envelope being mailed, next to the return address.

Referring again to FIG. 13, return receipt 86 is preferably configured to provide the functions of Postal Service Form 3811, being divided into a lower section 144 and an upper section 146 by a fold line 148. The postcard is formed after being printed, according to the folding method generally described in reference to FIGS. 1 through 7. Return receipt 86 is preferably pre-printed to form a background color with a half tone screen, using the same green ink used to pre-print information on sender's receipt section 84 and certified mail label 85. The half tone screen permits simulation of the light green card stock used by the U.S. Postal Service to make Form 3811 easily recognizable. Other pre-printed markings on return receipt 86 are preferably black. On the reverse side of Form 3811, upper section 146 includes a number of pre-printed blocks required on return receipt 86, such as block 150, which includes pre-printed instructions for the sender, block 152, which provides spaces to indicate whether additional services are desired, and block 154, which provides a space for the signature of the addressee.

In the printing process, the address of the certified mail recipient, which is placed in label area 90, is also placed in block 156 of lower section 146. In addition, the identifying number, which is placed in left margin 120 of sender's receipt section 84 and in central area 122 of certified mail label 85, is also printed in block 158, oriented to be readable when upper edge 108 of form 72 is held upward. Again, this number is printed, with a preceding letter "P," in an OCR-A font. In the same printing process, a bar code representing the identifying number may be printed below the number.

Return receipt 86 is prepared to be sent with the certified mail, for return to the sender, by the Postal Service, in verification of receipt of the mail. Therefore, lower section 144 is pre-printed for this purpose, with a U.S. MAIL emblem 160, as required to send a document through the mail on official business of the Postal Service. An FIM code 162 for this type of service is also pre-printed. During the pass through the printer, the sender's address and the POSTNET code representing the ZIP code within the sender's address are printed in appropriate locations on lower section 144. All printing on lower section 144 is done with an inverted orientation, so that the information will be read downward towards edge 108. Return receipt 86 is separable from discardable section 164 by means of tear line 132 extending through front section 74 so that it is the proper size.

Referring again to FIG. 15, a tear line 138 underlies tear line 132, and the front surface of a section 168 of back sheet 75, underlying upper section 146, is coated with release material 77. Section 168 is separable from the remainder of back sheet 75 by means of a transverse tear line 170 which underlies fold line 148 of front sheet 74. Before return receipt 86 is folded into postcard form, section 164 (shown in FIG. 13) is detached and discarded. Next, detachable backing section 168 is detached and discarded, tearing along tear line 170 to reveal an intact adhesive material 76 layer of first sheet 74, previously adjacent to the coated surface of panel 168. Then, the remaining portion of return receipt 86 is folded along fold line 148, with adhesive material 76 layer forming a tight bond with the rear surface of a panel 174 of back sheet 75. In order to facilitate the alignment of adhesive 76 with the rear surface of panel 174, a gap 175, about a half inch in width, is provided in the adhesive material 76, extending upward from fold line 148. The structure of various elements, before and after the folding procedure, is similar to that which has been previously described and shown in FIGS. 4 and 6, respectively.

Figure 16:
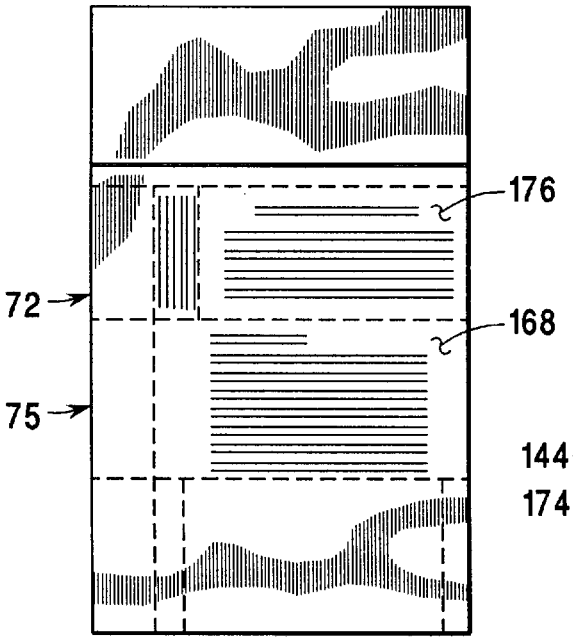
FIG. 16 is a rear elevational view of the embodiment of FIG. 13, showing the relative placement of pre-printed information thereon.

As shown in FIG. 16, various types of information, such as instructions on the use of form 72, may be printed on the outward facing surface of back sheet 75, which is the rear surface of form 72 after sheets 74 and 75 are assembled. For example, even through detachable backing section 168 is removed and discarded during the process of forming return receipt 86 into a postcard, its back surface can be used for providing pre-printed information regarding how the various parts of form 72 should be separated, folded, and used. Other sections of back sheet 75 are not discarded; remaining instead with corresponding sections of front sheet 74. The rear surfaces of such sections are particularly useful for providing pre-printed information relative to the use of these particular sections. For example the back sheet portion 176 of sender's receipt 84 can be used in this way.

Referring again to FIG. 13, as previously mentioned, return receipt 86 is prepared to be sent with the certified mail. To this end, a special provision is made for the attachment of return receipt 86 to the certified mail being sent, through the use of tabs 177 extending at each end of lower section 144. As shown in FIG. 15, release material 182 is applied over tabs 178 as a part of back sheet 75.

Figure 17:
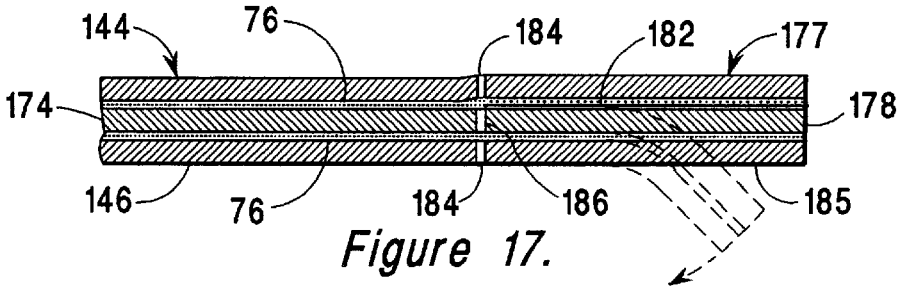
FIG. 17 is a transverse cross-sectional view of an attachment tab portion of the embodiment of FIG. 13, shown after a portion of the embodiment is folded into a postcard configuration as indicated by section lines XVII—XVII in FIG. 13.

Attachment of return receipt 68 to a mailing envelope or package will now be explained, with particular reference being made to FIGS. 17 and 18, which are transverse cross-sectional views of one of the tabs 177, together with adjacent portions of front section 144 and reverse section 146. FIG. 17 is taken as indicated by section line XVII—XVII in on lower section 144 of FIG. 13 after return receipt 86 has been folded into a postcard configuration along fold line 148.

Referring to FIG. 17, when return receipt 86 is folded into a postcard configuration, lower section 144 and rear section 146 of front sheet 74 become outer layers in an assembly having three layers, including a central layer formed by backing panel 174, with single adhesive material 76 layers between each of the paper layers. This portion of FIG. 17 is similar to FIG. 6. However, underlying tab 177, which extends outward from lower section 144, is release material layer 182 for limiting the adhesive attraction between tab 177 and tab 178.

Figure 18:
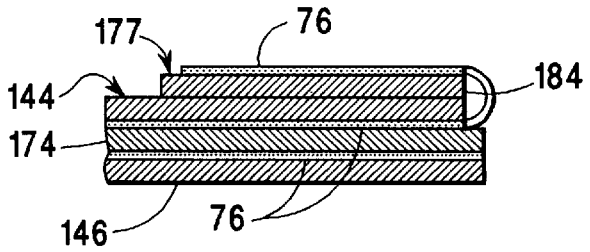
FIG. 18 is a transverse cross-sectional view of the attachment tab portion of the embodiment of FIG. 13, shown after the tab is folded to expose an adhesive material layer for attachment to another object.

Referring to FIG. 18, the presence of release material 182 makes it easy to peel tab 177 upward, about a tear line 184 extending through front sheet 74 between lower section 144 and tab 177. After both tabs 177 are folded upward in this way, adhesive 76 covered surfaces are upwardly exposed for use in the attachment of return receipt 86 to an article being sent by certified mail. At this point, tabs 178 and an underlying tabs 185, which extend outward from reverse section 146, may be detached, by tearing along tear lines 186 between tabs 178 and section 174, and the portions of tear lines 184 between tabs 185 and upper section 146. When the article is subsequently successfully delivered, the postal worker separates return receipt 86 from the article, tearing along tear lines 184 to separate tabs 177, which remain with the article, from the remainder of return receipt 86. The postal worker then sends return receipt 86, through the mail, back to the sender, as indicated by the sender's address on lower section 144.

The method described above for attaching return receipt 86 to the article being mailed has an advantage over the method described in U.S. Pat. No. 4,683,792 to Walz. With the method described above, the adhesive surfaces used for fastening to the article are moved inward from the outer edges of the card forming return receipt 86; with the method of Walz, the adhesive strips extend outward from the card. This reduction in the length of the return receipt, as it is attached to the article being mailed, provides more flexibility for locating the return receipt of the present invention on different types of articles being mailed.

Variations of the fourth embodiment of this invention, which has been discussed above in reference to FIGS. 12 through 18, will now be discussed in reference to FIGS. 19 through 24, with previously discussed common features being accorded like reference numerals. These variations exhibit differences in the resulting configuration of the adhesive tabs used to attach the return receipt portion of the form to the certified mail being sent.

Figure 19:
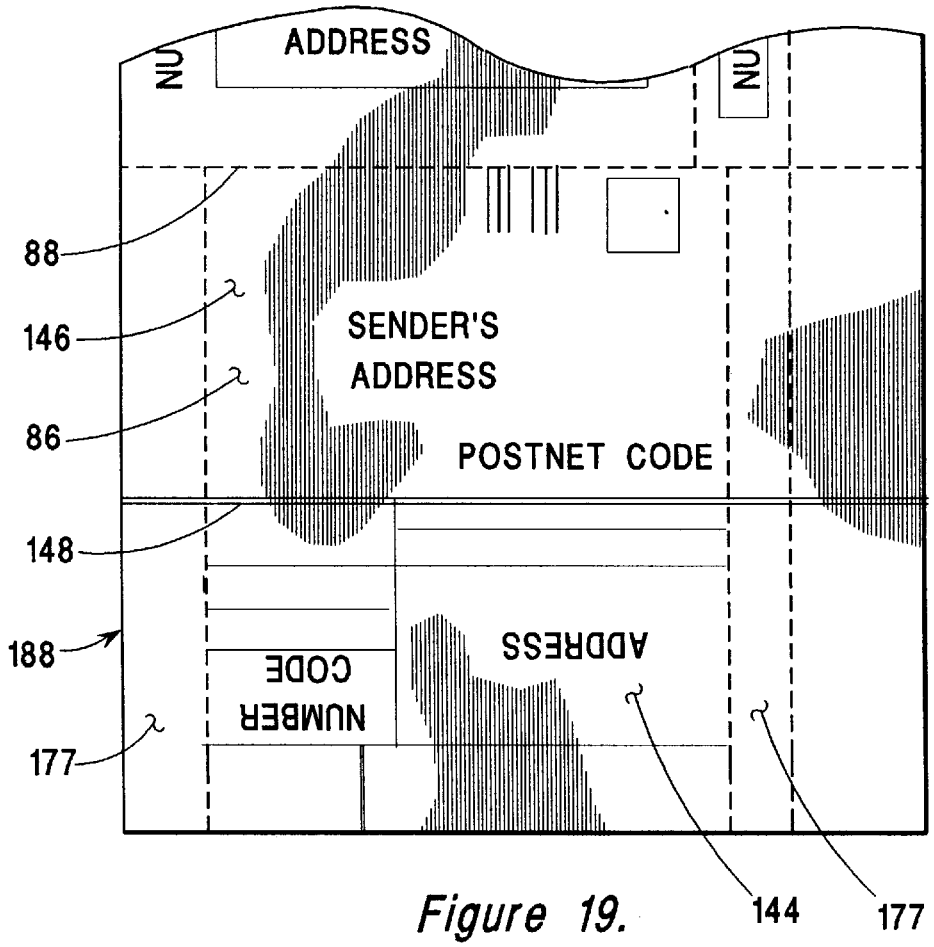
FIG. 19 is a partial front elevational view of a first variation of the embodiment of FIG. 13, showing the relative placement of information thereon during the pre-printing step and during the printing step with a printer.

Referring first to FIG. 19, the pre-printed information on a return receipt portion 86, of a first alternative form 188, are inverted, or rotated together 180 degrees, from the similar information shown in FIG. 13 on form 74. Furthermore, the information printed in this area by the printer is similarly inverted from the locations shown in FIG. 13. Thus, on form 188, the senders address 190, printed by the printer, and the U.S. MAIL emblem 170, which is part of the pre-printed information, are located on upper section 146. Also, on form 188, the pre-printed information, and the information printed by the printer, for the reverse portion of the return receipt card, are printed on lower section 144. The pre-printed and printed information above tear line 88 remains as previously discussed and shown in FIG. 13.

After the appropriate information is printed, form 188 is separated into its various elements as discussed above with respect to FIGS. 12 through 16, and folded into the configuration shown in FIG. 17. However, it is still necessary to attach the return receipt portion of the form to the certified mail being sent with the sender's address portion facing inward, toward the certified mail. Thus, it is now necessary to attach form 188 so that section 146 faces inward. This is accomplished by removing tabs 185 and 178, shown in FIG. 17, to expose the layer of adhesive material 76 on tabs 177. The release material 182 on the front surface of backing layer 75 (also shown in FIG. 15) allows the separation of tabs 178 from the adhesive material 76 layer on tabs 178.

Figure 20:
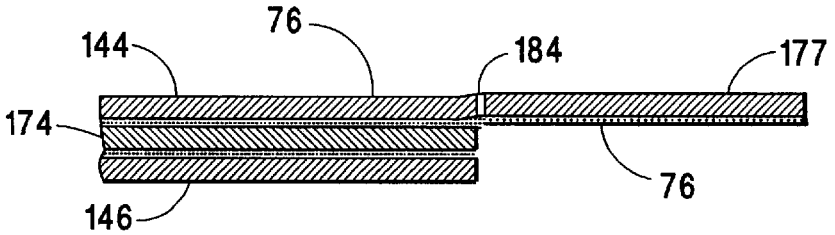
FIG. 20 is a transverse cross-sectional view of the attachment tab portion of the version of FIG. 19, shown after tabs are removed to expose an adhesive material layer for attachment to another object.

Referring to FIG. 20, after the removal of tabs 185 and 178, the outer surface of section 146 and the adhesive material 76 layer on tabs 177 both face in the same direction, in which the form 188 is subsequently applied for attachment to the mail being sent. The difference between the previously explained version, in which the tabs were folded, as shown in FIG. 18, and this version, in which the tabs are left extended, as shown in FIG. 20, may be considered to lie in the fact that, in the previously explained version of FIG. 18, the section of the postcard to be placed against the mail to be sent is attached to the back sheet 75 along a surface without a release material layer, while, in this version of FIG. 20, the section to be placed against the mail to be sent is attached to back sheet 75 along a surface with a release material layer. This difference reverses the way the printed information lies with respect to the back sheet section removed prior to folding, and thereafter to the location of release material layers 182 on back sheet 75. When the certified mail is delivered, the central portion of form 188 is removed for return by tearing along tear lines 184.

While the method of FIG. 20 has the disadvantage, compared to the method of FIG. 18, of lengthening the document to be attached to the certified mail to be sent, the elimination of a folding step simplifies the use of form 188, while providing somewhat greater strength to hold the attachment tabs to the rest of the form during the mailing procedure.

Figure 24:
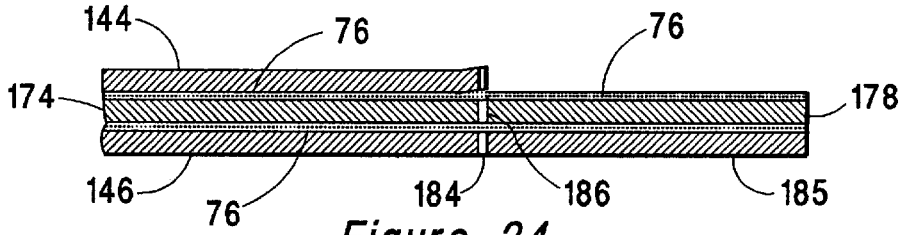
FIG. 24 is a transverse cross-sectional view of the attachment tab portion of FIG. 21, shown after tabs are removed to expose an adhesive material layer for attachment to another object.

A second alternative version for providing attachment tabs will now be discussed, with particular reference being made to FIGS. 21 through 24. Specifically, FIG. 21 shows a partial rear elevational view of the front sheet of this version, FIG. 22 shows a front elevational view of the back sheet of this version, FIG. 23 shows a transverse cross-sectional view of an attachment tab portion of this version after folding into a postcard configuration, and FIG. 24 shows a similar transverse cross-sectional view after certain tabs are removed to expose the adhesive material 76 layer for attachment.

Figure 21:
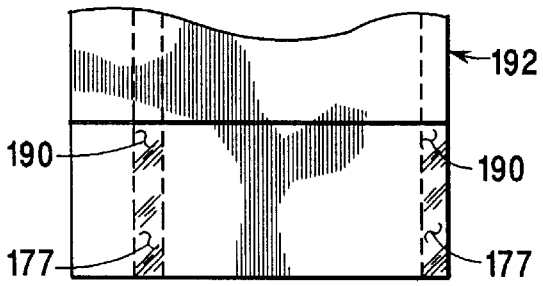
FIG. 21 is a rear elevational view of a front sheet of a second variation of the embodiment of FIG. 13, shown after the application of a release material coating, but before the application of an adhesive material layer.
Figure 22:
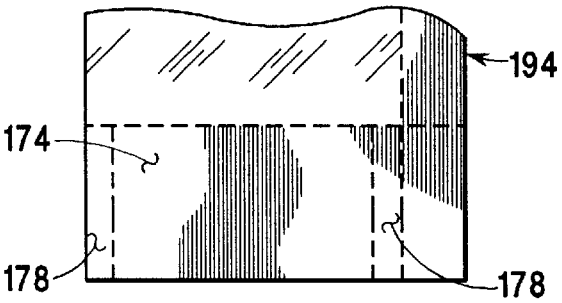
FIG. 22 is a front elevational view of a back sheet used in the variation of FIG. 21.

Referring first to FIG. 21, in the manufacture of the second alternative version, a release material coating 190 is applied to the interior surface of a front sheet 192 in the areas of tabs 177. After the application of release material coating 190, an adhesive material coating, such as coating 76 seen in FIG. 14, is applied to the interior surface of front sheet 192 as previously described and shown in FIG. 14. The adhesive coating is thus applied directly over the release material 190, resulting in a bond which can be subsequently torn apart with relative ease. Referring to FIG. 22, the back sheet 194 of the second alternative version is as previously described and shown in FIG. 15, except that a release material coating is not applied to the front surfaces of tabs 178. The form of this version is otherwise as previously described in reference to FIGS. 13 through 17.

Figure 23:
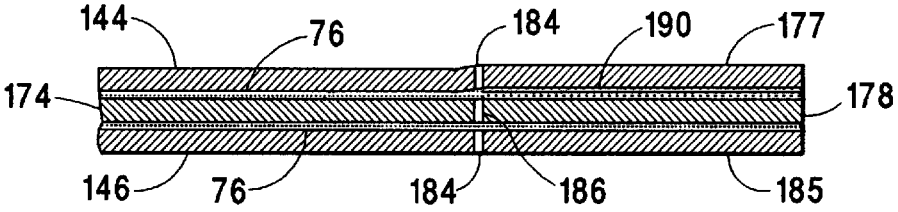
FIG. 23 is a transverse cross-sectional view of an attachment tab portion of the variation of FIG. 21, shown after a portion of the embodiment is folded into a postcard configuration as indicated by section lines XVII—XVII in FIG. 13.

Referring to FIG. 23, after the printing step, the form of the second alternative version is folded to provide an attachment tab configuration having a section 144, which is to be placed against the mail being sent, from which a tab 177 extends at each end, with each such tab 177 being separated from the adhesive material 76 layer by a release material coating 190, so that each tab 177 can be easily removed. Referring to FIG. 24, after the tabs 177 (shown in FIG. 22) are removed and discarded, a double sheet thickness of tabs 178 and 185 remains, presenting an adhesive material 76 layer on an outer surface of tab 178 for attachment to the mail being sent.

Thus, while the second alternative version has the disadvantage of extending tabs, when compared to the version described in FIGS. 12 through 18, and of requiring the additional process of coating a material release layer 190 on the rear surface of the front sheet, an advantage is gained of providing a stronger attachment to the mail being sent, since the attachment tabs 177 have double sheet thicknesses, rather than single sheet thicknesses.

A further advantage of all these alternatives over the use of the form described in U.S. Pat. No. 4,683,792 to Walz is realized, in many applications, by the fact that the form of the present invention can easily be handled as a single sheet, instead of as a portion of a long, continuous pre-printed form having separable sections. Thus, for example, when a letter to be sent by certified mail is completed, form 72 can be simply loaded, as a single sheet, into a printer, for preparing the various forms needed for the certified mail process, including address information for the envelope. Most, if not all, printers used in word processing applications accept a single sheet manual loading in this way. At the same time, the program for generating the information for form 72 may be accessed by the computer. When the single form is printed, the next job can be started. In other words, with the present invention, it is not necessary to accumulate information for a number of certified mail documents before beginning the printing of sections of the continuous form described by Walz.

The most significant advantage of each of the certified mail form embodiments described above is that the thickness of the form is substantially constant throughout. Other existing forms generally have different thickness for the post card and remaining documents on the form and this differing thickness can cause jams in the feeding system of common printers.

While the use of a nonimpact printer to provide variable information on the various forms described herein is particularly advantageous, it is to be understood that an impact printer could be used in a similar way. Generally, the invention has been described in its preferred form or embodiment with some degree of particularity, it is to be understood that this description has been given only by way of example and that numerous changes in the details of construction, fabrication and use, including the combination and arrangement of parts, may be made without departing from the spirit and scope of the invention.

What is claimed is:

1. An assembly adapted to being folded to form a folded document with images on both sides thereof, following a single pass of said assembly through an image forming device which places an image only on one side of said assembly, said assembly comprising:

a front sheet including an image receiving surface, and an adhesive coated surface;

a back sheet having an outward facing surface, an interior surface, and a first tear line between said interior and outward facing surfaces, said interior surface being affixed to said adhesive coated surface of said front sheet such that a permanent bond is formed on one side of said tear line and a releasable bond is formed on the other side of said tear line, a release material being affixed on said interior surface of said back sheet on said other side of said tear line; and a fold line on said front sheet aligned with said tear line when said front sheet and back sheet are affixed, all images formed by said image forming device occurring on said image receiving surface and on both sides of said fold line;

said folded document being formed by removing a portion of said back sheet on said other side of said tear line, thereby exposing said adhesive coated surface of said front sheet and leaving a remaining portion of said back sheet, and folding said front sheet about said fold line so that said exposed adhesive coated surface contacts said remaining portion of said back sheet.

2. The assembly of claim 1 wherein said other side of said tear line of said back sheet and said release material are removable to expose said adhesive coated surface and to permit a portion of said front sheet with said exposed adhesive coated surface to be folded at said fold line and be permanently affixed to a portion of said outward facing surface of said back sheet.

3. The assembly of claim 1 wherein said adhesive coated surface includes an adhesive coating extending in both directions from a linear gap, said gap being positioned along said fold line.

4. The assembly of claim 3 wherein said gap is one half inch in width.

5. The assembly of claim 3 wherein said adhesive coating face is juxtaposed to one side of said fold line.

6. The assembly of claim 1 for providing a plurality of folded documents in which said first tear line extends in a first direction across said assembly, further comprising at least one second tear line extending in a direction perpendicular to said first direction across said front sheet and at least one third tear line underlying said second tear line on back sheet.

7. The assembly of claim 6 wherein each of said foldable documents can be separated along said second and third tear lines and folded into documents suitable for mailing as postcards.

8. The assembly of claim 7 wherein said front sheet includes pre-printed information on said image receiving surface.

9. The assembly of claim 1 wherein said front and back sheets have a quadrate shape, each sheet having a pair of spaced apart first edges and a pair of spaced apart second edges, said fold line being parallel to said second edge of said front sheet and said first tear line being parallel to said second edge of said back sheet, said front and back sheets each including second and third tear lines parallel to and spaced from an associated first edge thereof, said interior surface of said back sheet being affixed to said adhesive coated surface of said front sheet such that a releasable bond is formed between each of said second tear lines and its associated first edge and between said third tear lines and its associated first edge.

10. The assembly of claim 9 wherein said front sheet includes an adhesive coated on said adhesive coated surface and said back sheet further includes said release material being affixed to said interior surface of said back sheet between said second and third tear lines and said associated first sides.

11. The assembly of claim 10 wherein said other side of said first tear line of said back and said release material affixed thereto are removable to expose said adhesive coated surface and to permit said portion of said front sheet with said exposed adhesive coated surface to be folded at said fold line and be permanently affixed to the remaining outward facing surface of said back sheet.

12. The assembly of claim 11 wherein said adhesive coating extends in both directions from a linear gap, said gap being positioned along said fold line, said coated adhesive includes a gap extending along said fold line.

13. The assembly of claim 9 wherein said front sheet includes a release material affixed to a first portion of said adhesive coated surface between said second and third tear lines and said associated first sides, said front sheet further including an adhesive coated over said release material and the remaining portion of said adhesive coated surface.

14. The assembly of claim 13 wherein said adhesive coating extends in both directions from a linear gap, said gap being positioned along said fold line, said coated adhesive includes a gap extending along said fold line.

15. An assembly adapted to being folded to form a folded document with images on both sides thereof, following a single pass of said assembly through an image forming device which places an image only on one side of said assembly when unfolded, said assembly comprising:

a first sheet of paper having an image receiving surface and a fold line, all images formed by said image forming device occurring on said image receiving surface and on both sides of said fold line, said fold line permitting said first sheet of paper to be folded, whereby said images appear on both sides of said folded document, when folded;

a pressure sensitive adhesive coated on a side of said first sheet opposite said image receiving surface, said opposite surface having a gap without adhesive extending along said fold line;

a second sheet of paper having an interior surface, a back surface and a tear line therebetween, said first and second sheets being the same size; and a release material coated on one portion of said interior surface of said second sheet in a first direction away from said tear line, said interior surface and opposite surface being maintained together by said adhesive and said fold line and tear line being aligned with one another;

said folded document being formed by removing a remaining portion of said second sheet in a direction opposite to said first direction from said tear line, thereby exposing said adhesive on said opposite side of said first sheet and leaving said one portion of said second sheet, and folding said first sheet about said fold line so that said exposed adhesive contacts said back surface of said one portion of said second sheet.

16. The assembly of claim 15 wherein said gap extends from one side of said fold line in a second direction opposite to said first direction for a predetermined distance.

17. The assembly of claim 16 wherein said first sheet of paper includes a tab for permitting attachment of said assembly to another object; and said release material is further coated so as to be between the adhesive coated tab and said interior surface.

18. The assembly of claim 17 wherein said first and second sheets include tear lines permitting the removable of a portion of said tab for exposing said adhesive coated over the remaining portion of said tab.

19. The assembly of claim 15 wherein said pressure sensitive adhesive is juxtaposed to one side of said fold line.

* * * * *